US005659658A

United States Patent [19]

Vänskä

[11] Patent Number: 5,659,658

[45] Date of Patent: Aug. 19, 1997

[54] METHOD FOR CONVERTING SPEECH USING LOSSLESS TUBE MODELS OF VOCALS TRACTS

[75] Inventor: Marko Vänskä, Nummela, Finland

[73] Assignee: Nokia Telecommunications OY, Espoo, Finland

[21] Appl. No.: 313,195

[22] PCT Filed: Feb. 10, 1994

[86] PCT No.: PCT/FI94/00054

§ 371 Date: Dec. 2, 1994

§ 102(e) Date: Dec. 2, 1994

[87] PCT Pub. No.: WO94/18669

PCT Pub. Date: Aug. 18, 1994

[30] Foreign Application Priority Data

Feb. 12, 1993 [FI] Finland ..... 930629

[51] Int. Cl.[6] ..... G10L 9/00

[52] U.S. Cl. ..... 395/2.7; 395/2.09; 395/2.67; 395/2.71; 395/2.72; 395/2.73; 395/2.74; 395/2.75; 395/2.76; 395/2.77; 395/2.8; 395/2.86; 395/2.87

[58] Field of Search ..... 395/2, 2.67, 2.7, 395/2.72–2.77, 2.8, 2.86, 2.87; 381/29–35, 51, 53

[56] References Cited

U.S. PATENT DOCUMENTS

| | | | |
|---|---|---|---|
| 3,909,533 | 9/1975 | Willimann | 395/2.7 |
| 4,624,012 | 11/1986 | Lin et al. | 395/2.7 |
| 5,097,511 | 3/1992 | Suda et al. | 395/2.7 |
| 5,522,013 | 5/1996 | Vanska | 395/2.7 |
| 5,528,726 | 6/1996 | Cook | 395/2.7 |

*Primary Examiner*—Allen R. MacDonald
*Assistant Examiner*—Michael N. Opsasnick
*Attorney, Agent, or Firm*—Cushman Darby & Cushman IP Group of Pillsbury Madison & Sutro LLP

[57] ABSTRACT

A method of converting speech, in which reflection coefficients are calculated from a speech signal of a speaker. From these coefficients, characteristics of cross-sectional areas of cylinder portions of a lossless tube modelling the speaker's vocal tract are calculated. Sounds are identified from those characteristics of the speaker and provided with respective identifiers. Subsequently, differences between the stored characteristics representing at least one sound and respective characteristics representing the same at least one sound are calculated, a second speaker's speaker-specific characteristics modelling that speaker's vocal tract for the same at least one sound are searched for in a memory on the basis of the identifier of the respective identified sound, a sum is formed by summing the differences and the second speaker's speaker-specific characteristics modelling that second speaker's vocal tract for the respective same sound, new reflection coefficients are calculated (614) from that sum, and a new speech signal is produced from the new reflection coefficients.

2 Claims, 5 Drawing Sheets

METHOD FOR CONVERTING SPEECH USING LOSSLESS TUBE MODELS OF VOCALS TRACTS

FIELD OF THE INVENTION

The invention relates to a method of converting speech, in which method samples are taken of a speech signal produced by a first speaker for the calculation of reflection coefficients.

BACKGROUND OF THE INVENTION

The speech of speech-handicapped persons is often unclear and sounds included therein are difficult to identify. The speech quality of speech-handicapped persons causes problems, especially when a communications device or network is used for transmitting and transferring a speech signal produced by a speech-handicapped person to a receiver. On account of the limited transmission capacity and acoustic properties of the communications network, the speech produced by the speech-handicapped person is then still more difficult to identify and understand for a listener. On the other hand, regardless of whether a communications device or network transferring speech signals is used, it is always difficult for a listener to identify and understand the speech of a speech-handicapped person.

In addition, at times there is a need to try to change speech produced by a speaker in such a way that the sounds of the speaker would be corrected to provide a better sound format, or that the sounds of the speech produced by that speaker would be converted into the same sounds of another speaker and then the speech of the first speaker would actually sound like the speech of the second speaker.

SUMMARY OF THE INVENTION

The object of this invention is to provide a method, by which a speech of a speaker can be changed or corrected in such a way that the speech heard by a listener or the corrected or changed speech signal obtained by a receiver corresponds either to speech produced by another speaker, or to the speech of the same speaker corrected in some desired manner.

This novel method of converting speech is provided by a method according to the invention, which is characterized by the following method steps: from the reflection coefficients are calculated characteristics of cross-sectional areas of cylinder portions of a lossless tube modelling the first speaker's vocal tract, those characteristics of the cross-sectional areas of the cylinder portions of the lossless tube of the first speaker are compared with at least one previous speaker's respective stored sound-specific characteristics of cross-sectional areas of cylinder portions of a lossless tube modelling the speaker's vocal tract for the identification of sounds, and for providing identified sounds with respective identifiers, differences between the stored characteristics of the cross-sectional areas of the cylinder portions of the lossless tube modelling the speaker's vocal tract for the respective sound and the respective following characteristics for the same sound are calculated, a second speaker's speaker-specific characteristics of cross-sectional areas of cylinder portions of a lossless tube modelling that speaker's vocal tract for the same sound are searched for in a memory on the basis of the identifier of the identified sound, a sum is formed by summing the aforementioned differences and the second speaker's speaker-specific characteristics of the cross-sectional areas of the cylinder portions of the lossless tube modelling that speaker's vocal tract for the same sound, new reflection coefficients are calculated from that sum and a new speech signal is produced from those new reflection coefficients.

The invention is based on the idea that a speech signal is analyzed by means of the LPC (Linear Prediction Coding) method, and a set of parameters modelling a speaker's vocal tract is created, which parameters typically are characteristics of reflection coefficients. According to the invention, sounds are then identified from the speech to be converted by comparing the cross-sectional areas of the cylinders of the lossless tube calculated from the reflection coefficients of the sound to be converted with several speakers' previously received respective cross-sectional areas of the cylinders calculated for the same sound. After this, some characteristic, typically an average, is calculated for the cross-sectional areas of each sound for each speaker. Subsequently, from this characteristic are subtracted sound parameters corresponding to each sound, i.e. the cross-sectional areas of the cylinders of the speaker's lossless vocal tract, providing a difference to be transferred to next conversion step together with the identifier of the sound. Before that, the characteristics of the sound parameters corresponding to each sound identifier of the speaker to be imitated, i.e. the target person, have been agreed upon, and therefore, by summing said difference and the characteristic of the sound parameters for the same sound of the target person searched for in the memory, the original sound may be reproduced, but as if the target person would have uttered it. By adding that difference, information between the sounds of the speech is brought along, i.e. the sounds not included in the sounds on the basis of the identifiers of which the characteristics corresponding to those sounds have been searched for in the memory, i.e. typically the averages of the cross-sectional areas of the cylinders of the lossless tube of the speaker's vocal tract.

An advantage of such a method of converting speech is that the method makes it possible to correct errors and inaccuracies, occurring in speech sounds and caused by the speaker's physical properties, in such a way that the speech can be more easily understood by the listener.

Furthermore, the method according to the invention makes it possible to convert a speaker's speech into speech sounding like the speech of another speaker.

The cross-sectional areas of the cylinder portions of the lossless tube model used in the invention can be calculated easily from so-called reflection coefficients produced in conventional speech-coding algorithms. Naturally, some other cross-sectional dimension of the area, such as radius or diameter, may also be determined to a reference parameter. On the other hand, instead of being circular, the cross-section of the tube may also have some other shape.

BRIEF DESCRIPTION OF THE DRAWINGS

In the following, the invention will be described in more detail with reference to the attached drawings, in which.

DETAILED DESCRIPTION OF A PREFERRED EMBODIMENT OF THE INVENTION

Figure 1:
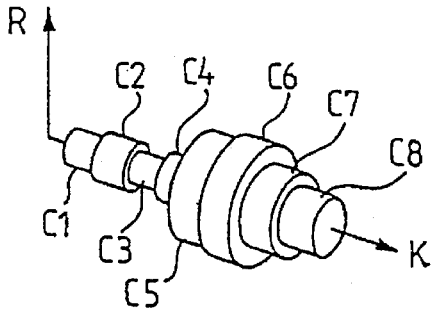
FIGS. 1 and 2 illustrate a model of a speaker's vocal tract by means of a lossless tube comprising successive cylinder portions of the lossless tube modelling the speaker's vocal tract.
Figure 2:
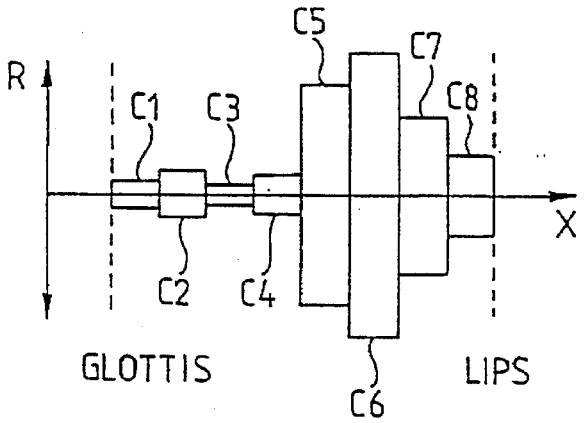

Reference is now made to FIG. 1 showing a perspective view of a lossless tube model comprising successive cylinder portions C1 to C8 and constituting a rough model of a human vocal tract. The lossless tube model of FIG. 1 can be seen in side view in FIG. 2. The human vocal tract generally refers to a vocal passage defined by the human vocal cords, the larynx, the mouth of pharynx and the lips, by means of which tract a person produces speech sounds. In FIGS. 1 and 2, the cylinder portion C1 illustrates the shape of a vocal tract portion immmediately after the glottis between the vocal cords, the cylinder portion C8 illustrates the shape of the vocal tract at the lips and the cylinder portions C2 to C7, in between, illustrate the shape of the discrete vocal tract portions between the glottis and the lips. The shape of the vocal tract typically varies continuously during speaking, when sounds of different kinds are produced. Similarly, the diameters and areas of the discrete cylinders C1 to C8 representing the various parts of the vocal tract also vary during speaking. However, a previous international patent application WO 92/20064 of this same inventor discloses that the average shape of the vocal tract calculated from a relatively high number of instantaneous vocal tract shapes is a constant characteristic of each speaker, which constant may be used for a more compact transmission of sounds in a telecommunication system, for recognizing the speaker or even for converting the speaker's speech. Correspondingly, the averages of the cross-sectional areas of the cylinder portions C1 to C8 calculated in the long term from the instantaneous values of the cross-sectional areas of the cylinders C1 to C8 of the lossless tube model of the vocal tract are also relatively exact constants. Furthermore, the values of the cross-sectional dimensions of the cylinders are also determined by the values of the actual vocal tract and are thus relatively exact constants characteristic of the speaker.

The method according to the invention utilizes so-called reflection coefficients produced as a provisional result of Linear Predictive Coding (LPC), which is well-known in the art, i.e. so-called PARCOR-coefficients $r_K$ having a certain connection with the shape and structure of the vocal tract. The connection between the reflection coefficients $r_K$ and the areas $A_K$ of the cylinder portions $C_K$ of the lossless tube model of the vocal tract is according to the formula (1)

$$-r(k)=\frac{A(k+1)-A(k)}{A(k+1)+A(k)} \quad (1)$$

where k=1, 2, 3, . . .

The LPC analysis producing the reflection coefficients used in the invention is utilized in many known speech coding methods.

Figure 4:
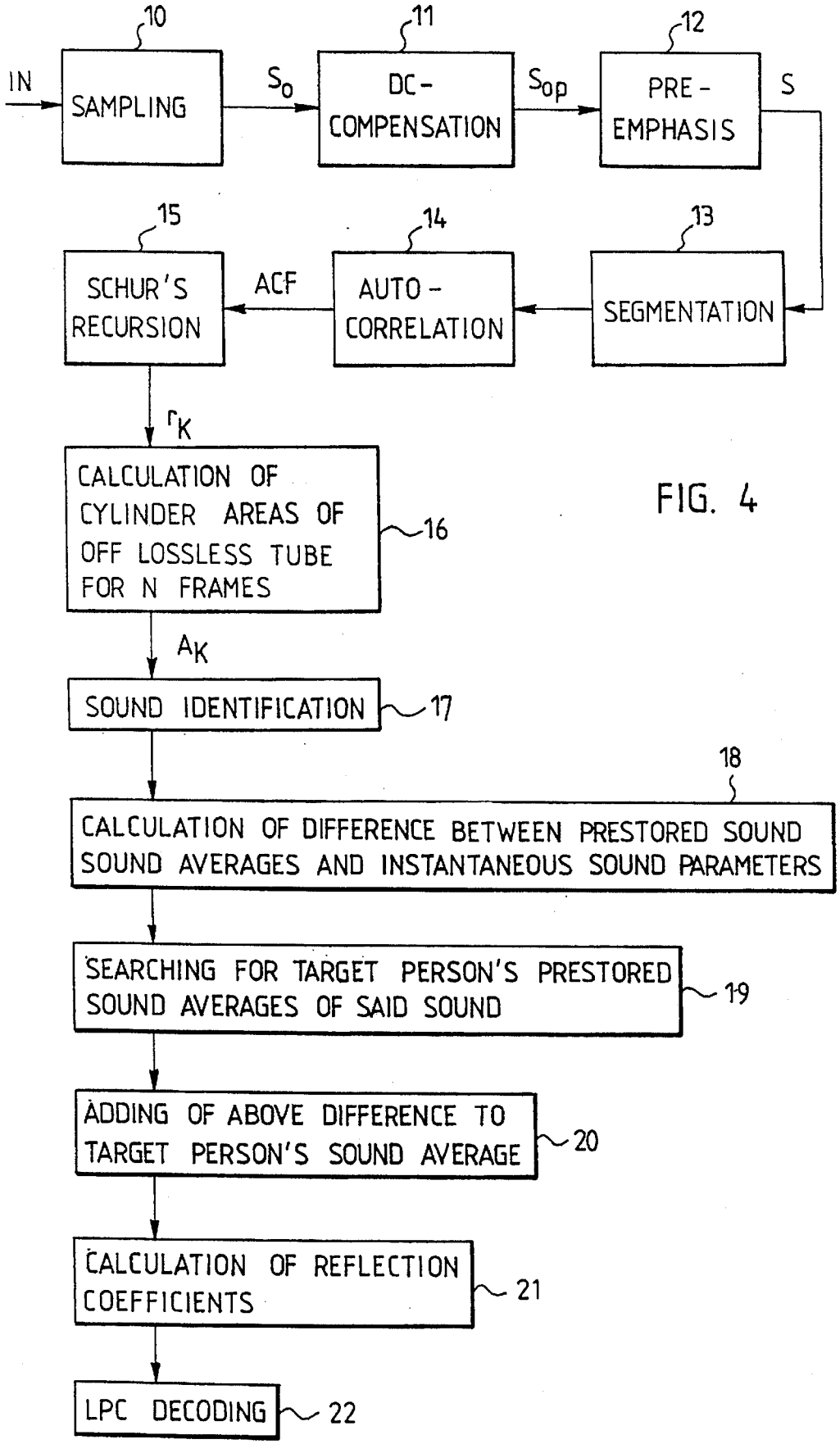
FIG. 4 shows a flow chart illustrating how sounds are identified and converted to comply with desired parameters.

In the following, these method steps will be described only generally in those parts which are essential for the understanding of the invention, with reference to the flow chart of FIG. 4. In FIG. 4, an input signal IN is sampled in block 10 at a sampling frequency of 8 kHz, and an 8-bit sample sequence $S_o$ is formed. In block 11, a DC component is extracted from the samples so as to eliminate an interfering side tone possible occurring in coding. After this, the sample signal is pre-emphasized in block 12, by weighting high signal frequencies by a first-order FIR (Finite Impulse Response) filter. In block 13, the samples are segmented into frames of 160 samples, the duration of each frame being about 20 ms.

In block 14, the spectrum of the speech signal is modelled by performing an LPC analysis on each frame by an auto-correlation method, the performance level being p=8. p+1 values of the auto-correlation function ACF are then calculated from the frame by means of the formula (2), as follows:

$$ACF(k)=\sum_{i=1}^{160} s(i)s(i-k) \quad (2)$$

where k=0, 1, . . . , 8.

Instead of the auto-correlation function, it is possible to use some other suitable function, such as a co-variance function. The values of eight so-called reflection coefficients $r_K$ of a short-term analysis filter used in a speech coder are calculated from the obtained values of the auto-correlation function by Schur's recursion or some other suitable recursion method. Schur's recursion produces new reflection coefficients every 20th ms. In one embodiment of the invention the coefficients comprise 16 bits and their number is 8. By applying Schur's recursion for a longer time, the number of the reflection coefficients can be increased, if desired.

In step 16, the cross-sectional area $A_K$ of each cylinder portion $C_K$ of the lossless tube modelling the speaker's vocal tract by means of the cylindrical portions is calculated from the reflection coefficients $r_K$ calculated from each frame. As Schur's recursion produces new reflection coefficients every 20th ms, 50 cross-sectional areas per second will be obtained for each cylinder portion $C_K$. After the cross-sectional areas of the cylinders of the lossless tube have been calculated, the sound of the speech signal is identified in step 17 by comparing these calculated cross-sectional areas of the cylinders with the values of the cross-sectional areas of the cylinders stored in a parameter memory. This comparing operation will be presented in more detail in connection with the explanation of FIG. 5*a*, referring to reference numerals 60, 60A and 61, 61A. In step 18, averages of the first speaker's previous parameters for the same sound are searched for in the memory and from these averages are subtracted the instantaneous parameters of a sample just arrived from the same speaker, thus producing a difference, which is stored in the memory.

Then, in step 19, the prestored averages of the cross-sectional areas of the cylinders of several samples of the target person's sound concerned are searched for in the memory, the target person being the person whose speech the converted speech shall resemble. The target person may also be, e.g., the first speaker, but in such a way that the articulation errors made by the speaker are corrected by using in this conversion step new, more exact parameters, by means of which the speaker's speech can be converted into more clear or more distinct speech, for example.

After this, in step 20, the difference calculated above in step 18 is added to the average of the cross-sectional areas of the cylinders of the same sound of the target person. From this sum are calculated in step 21 reflection coefficients, which are LPC-decoded in step 22, which decoding produces electric speech signals to be applied to a microphone or a data communications system, for instance.

Figure 3:
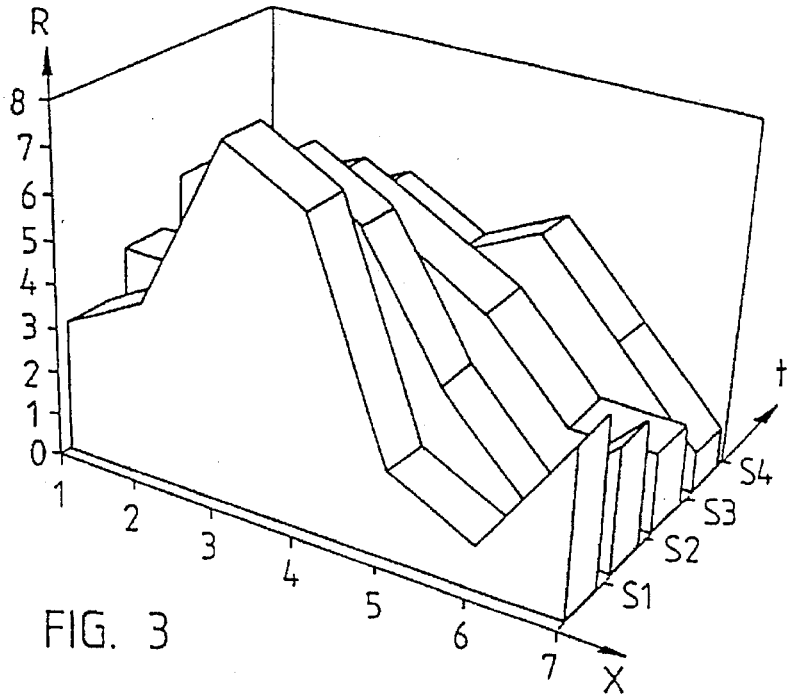
FIG. 3 illustrates how the lossless tube models change during speech.
Figure 5A:
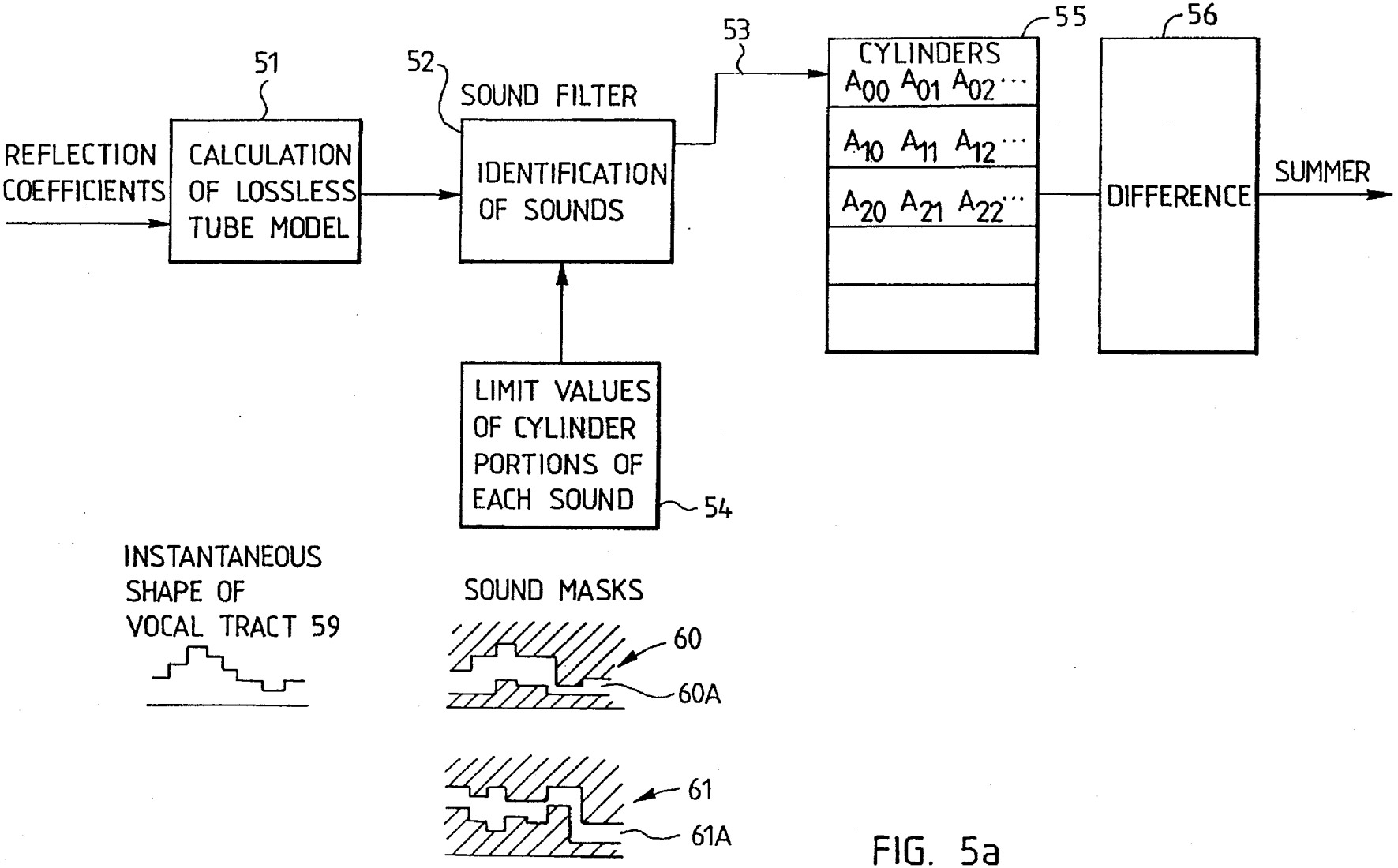
FIG. 5*a* is a block diagram illustrating speech coding according to the invention on a sound level in a speech converter.
Figure 5B:
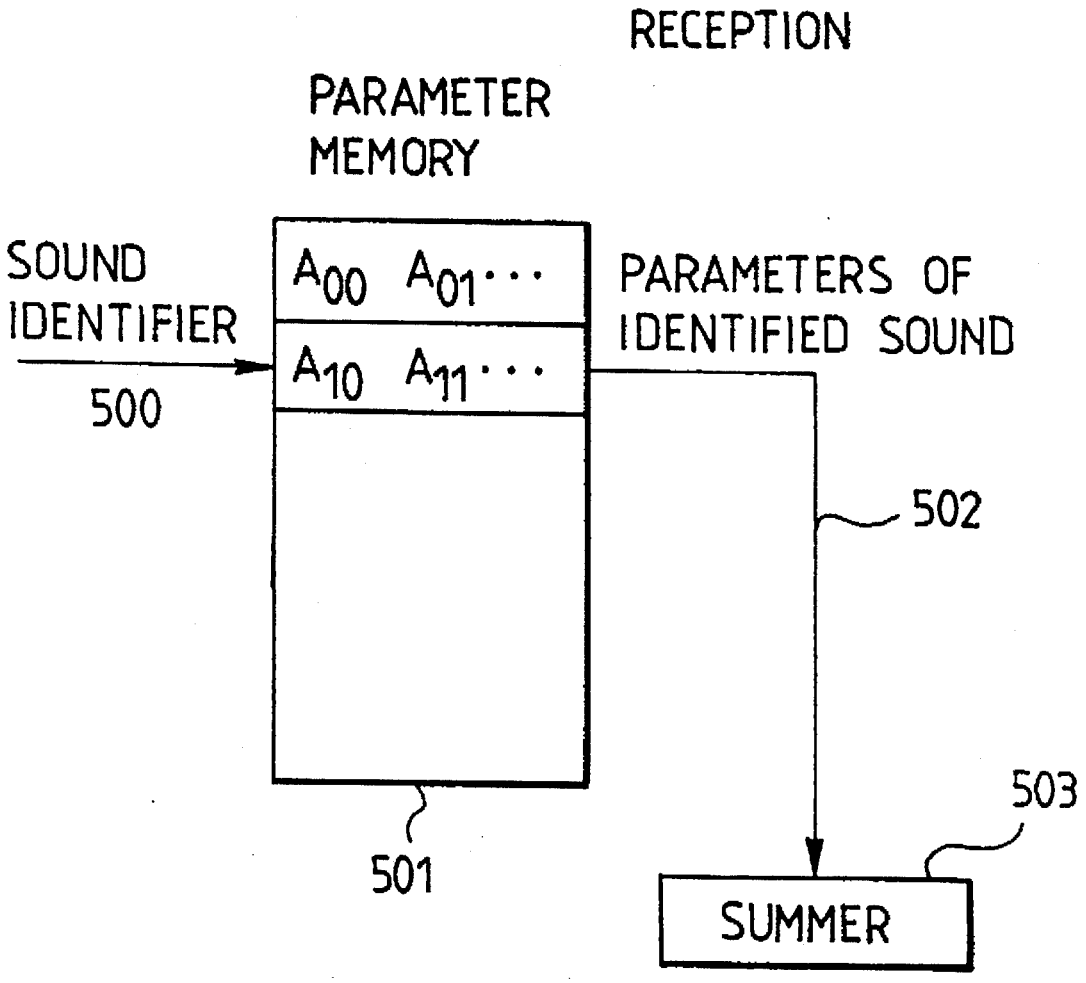
FIG. 5*b* is a transaction diagram illustrating a reproduction step of a speech signal on a sound level according to the invention by speech signal converting method.

In the embodiment of the invention shown in FIG. 5*a*, the analysis used for speech coding on a sound level is described in such a way that the averages of the cross-sectional areas of the cylinder portions of the lossless tube modelling the vocal tract are calculated from the areas of the cylinder portions of instantaneous lossless tube models created during a predetermined sound from a speech signal to be analyzed. The duration of one sound is rather long, so that several, even tens of temporally consecutive lossless tube models can be calculated from a single sound present in the speech signal. This is illustrated in FIG. 3, which shows four temporally consecutive instantaneous lossless tube models, S1 to S4. From FIG. 3, it can be seen clearly that the radii and cross-sectional areas of the individual cylinders of the lossless tube vary in time. For instance, the instantaneous models S1, S2 and S3 could, roughly classified, be created during the same sound, due to which an average could be calculated for them. The model S4, instead, is clearly different and associated with another sound and therefore not taken into account in the averaging.

In the following, speech conversion on a sound level will be described Kith reference to the block diagram of FIG. *5a*. Even though speech can be coded and converted by means of a single sound, it is reasonable to use at conversion all such sounds a conversion of which is desired to be performed in such a way that the listener hears them as new sounds. For instance, speech can be converted so as to sound as if another speaker spoke instead of the actual speaker, or so as to improve the speech quality, for example in such a way that the listener distinguishes the sounds of the converted speech more clearly than the sounds of the original, unconverted speech. At speech conversion can be used, for instance, all vowels and consonants.

The instantaneous lossless tube model 59 (FIG. *5a*) created from a speech signal can be identified, in block 52, to correspond to a certain sound, if the cross-sectional dimension of each cylinder portion of the instantaneous lossless tube model 59 is within the predetermined stored limit values of a known speaker's respective sound. These sound-specific and cylinder-specific limit values are stored in a so-called quantization table 54, creating a so-called sound mask. In FIG. *5a*, the reference numerals 60 and 61 illustrate how the above-mentioned sound- and cylinder-specific limit values create a mask or model for each sound, within the allowed area 60A and 61A (unshadowed areas) of which the instantaneous vocal tract model 59 to be identified has to fit. In FIG. *5a*, the instantaneous vocal tract model 59 fits the sound mask 60, but does obviously not fit the sound mask 61. Block 52 thus acts as a kind of sound filter, which classifies the vocal tract models into correct sound groups: a, e, i, etc. After the sounds have been identified, parameters corresponding to each sound, such as a, e, i, k, are searched for in a parameter memory 55 on the basis of identifiers 53 of the sounds identified in block 52 of FIG. *5a*, the parameters being sound-specific characteristics, e.g. averages, of the cross-sectional areas of the cylinders of the lossless tube. At the identification 52 of sounds, it has also been possible to provide each sound to be identified with an identifier 53, by means of which parameters corresponding to each instantaneous sound can be searched- for in the parameter memory 55. These parameters can be applied to a subtraction means 56 calculating, according to FIG. *5a*, the difference between the parameters of a sound searched for in the parameter memory by means of the sound identifier, i.e. the characteristic of the cross-sectional areas of the cylinders of the lossless tube, typically the average, and the instantaneous values of the respective sound. This difference is sent further to be summed and decoded in the manner shown in FIG. *5b*, which will be described in more detail in connection with the explanation of that figure.

FIG. *5b* is a transaction diagram illustrating a reproduction of a speech signal on a sound level in the speech conversion method according to the invention. An identifier 500 of an identified sound is received and parameters corresponding to the sound are searched for in a parameter memory 501 on the basis of the sound parameter 500 and supplied 502 to a summer 503 creating new reflection coefficients by summing the difference and the parameters. A new speech signal is calculated by decoding the new reflection coefficients. Such a creation of a speech signal by summing are shown in greater detail in FIG. 6 and described in greater detail in the explanation, below, corresponding thereto.

Figure 6:
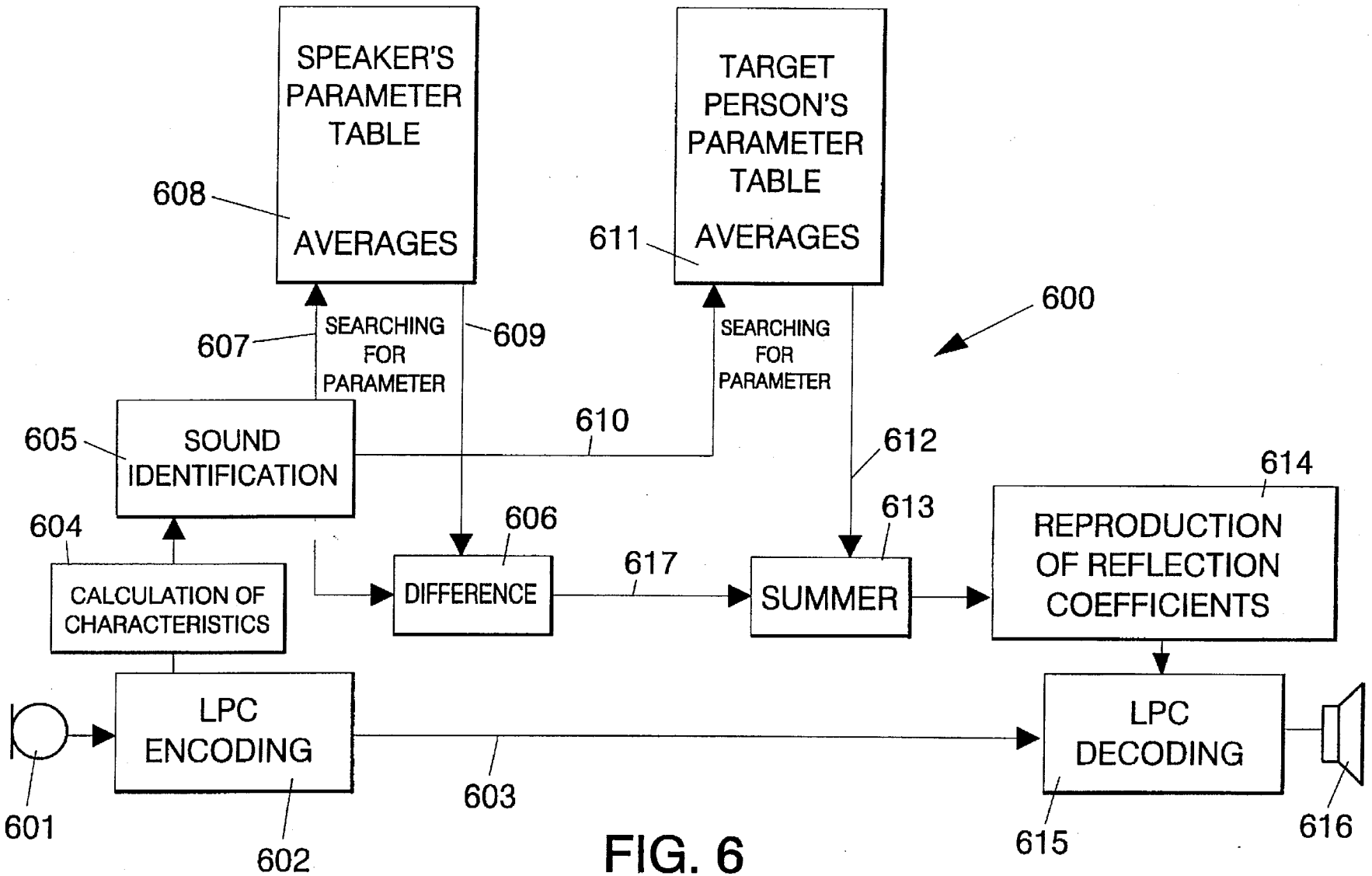
FIG. 6 is a functional and simplified block diagram of a speech converter implementing one embodiment of the method according to the invention.

FIG. 6 is a functional and simplified block diagram of a speech converter 600 implementing one embodiment of the method according to the invention. The speech of a first speaker, i.e. the speaker whose speech is to be converted, comes to the speech converter 600 through a microphone 601. The converter may also be connected to some data communication system, whereby the speech signal to be converted enters the converter as an electric signal. The speech signal detected by the microphone 601 is LPC-coded 602 (encoded) and from that are calculated reflection coefficients for each sound. The other parts of the signal are sent 603 forward to be decoded 615 later. The calculated reflection coefficients are transmitted to a unit 604 for the calculation of characteristics, which unit calculates from the reflection coefficients the characteristics of the cross-sectional areas of the cylinders of the lossless tube modelling the speaker's vocal tract for each sound, which characteristics are transmitted further to a sound identification unit 605. The sound identification unit 605 identifies the sound by comparing cross-sectional areas of cylinder portions of a lossless tube model of the speaker's vocal tract, calculated from the reflection coefficients of the sound produced by the first speaker, i.e. the speaker whose speech is to be converted, with at least one previous speaker's respective previously identified sound-specific values stored in some memory. As a result of this comparison, there is obtained the identifier of the identified sound. By means of the identifier of the identified sound, parameters are searched for 607, 609 in a parameter table 608 of the speaker, in which table have been stored earlier some characteristics, e.g. averages, of this first speaker's (whose speech is to be converted) respective parameters for the same sound and the subtraction means 606 subtracts from them the instantaneous parameters of a sample just arrived from the same speaker. Thus is created a difference, which is stored in the memory.

Further, by means of the identifier of the sound identified in block 605, the characteristic/characteristics corresponding to that identified sound, e.g. the sound-specific average of the cross-sectional areas of the lossless tube modelling the speaker's vocal tract calculated from the reflection coefficients, is searched for 610, 612 in a parameter table 611 of the target person, i.e. a second speaker being the speaker into whose speech the speech of the first speaker shall be converted, and is supplied to a summer 613. To the summer has also been brought 617 from the substraction means 606 the difference calculated by the subtraction means, which difference is added by the summer 617 to the characteristic/characteristics searched for in the parameter table 611 of the subject person, for instance to the sound-specific average of the cross-sectional areas of the cylinders of the lossless tube, modelling the speaker's vocal tract calculated from the reflection coefficients of the speaker's vocal tract. A total is then produced, from which are calculated reflection coefficients in a reproduction block 614 of reflection coefficients. Moreover, from the reflection coefficients can be produced a signal, in which the first speaker's speech signal is converted into acoustic form in such a way that the listener believes that he hears the second speaker's speech, though the actual speaker is the first speaker whose speech has been converted so as to sound like the second speaker's speech. This speech signal is applied further to an LPC decoder 615, in which it is LPC-decoded and the LPC uncoded parts 603 of the speech signal are added thereto. Thus is provided the final speech signal, which is converted into acoustic form in a loudspeaker 616. At this stage, this speech signal can be left in electric form just as well, and transferred to some data or telecommunication system to be transmitted or transferred further.

The above described method according to the invention can be implemented in practice, for instance by means of software, by utilizing a conventional signal processor.

The drawings and the explanation associated with them are only intended to illustrate the idea of the invention. As to the details, the method of converting speech according to the invention may vary within the scope of the claims. Though the invention has above been described primarily in connection with speech imitation, the speech converter can be utilized also for speech conversion of some other kind.

I claim:

1. A method for converting speech, comprising the steps of:

(a) sampling a speech signal produced by a first speaker:

(b) calculating reflection coefficients from the sampled speech produced by the first speaker;

(c) calculating from the reflection coefficients characteristics of cross-sectional areas of cylinder portions of a lossless tube modelling the first speaker's vocal tract;

(d) comparing said characteristics of said cross-sectional areas of said cylinder portions of said lossless tube of modelling said first speaker's vocal tract with at least one previous speaker's respective stored sound-specific characteristics of cross-sectional areas of cylinder portions of a lossless tube modelling said previous speaker's vocal tract for identifying sounds, and for providing sounds thereby identified as being the same in the first speaker's speech and the previous speaker's speech with respective identifiers;

(e) calculating differences between previously stored characteristics of the cross-sectional areas of the cylinder portions of the lossless tube modelling the first speaker's vocal tract for respective ones of said sounds and respective characteristics for the respective sounds as calculated in step (c);

(f) searching for a second speaker's speaker-specific characteristics of cross-sectional areas of cylinder portions of a lossless tube modelling the second speaker's vocal tract for the same sounds in a memory on the basis of the respective said identifiers of the respective sounds identified in step (d);

forming a sum by summing said differences and speaker-specific characteristics of the cross-sectional areas of the cylinder portions of the lossless tube modelling the second speaker's vocal tract for the respective same sounds;

calculating new reflection coefficients from that sum; and producing a new speech signal from said new reflection coefficients.

2. A method according to claim 1, further comprising:

calculating a characteristic for the physical dimensions of the lossless tube representing each said same sound of the first speaker; and storing said characteristic for the physical dimensions of the lossless tube representing each said same sound of the first speaker in a memory, for providing said previously stored characteristics of step (e).

* * * * *